US005507621A

United States Patent [19]

Cooper

[11] Patent Number: 5,507,621

[45] Date of Patent: Apr. 16, 1996

[54] COOLING AIR COOLED GAS TURBINE AEROFOIL

[75] Inventor: Brian G. Cooper, Derby, England

[73] Assignee: Rolls-Royce plc, Derby, England

[21] Appl. No.: 380,715

[22] Filed: Jan. 30, 1995

[30] Foreign Application Priority Data

Feb. 9, 1995 [UK] United Kingdom ..... 9402442

[51] Int. Cl.[6] ..... F01D 5/18

[52] U.S. Cl. ..... 416/97 R

[58] Field of Search ..... 416/96 A, 97 R, 416/115

[56] References Cited

U.S. PATENT DOCUMENTS

| | | | |
|---|---|---|---|
| 4,236,870 | 8/1980 | Hucul et al. . | |
| 4,278,400 | 7/1981 | Yamarik . | |
| 4,474,532 | 10/1984 | Pazder . | |
| 4,604,031 | 8/1986 | Moss et al. | 416/97 R |
| 4,775,296 | 10/1988 | Schwarzmann et al. | 416/97 R |
| 4,786,233 | 11/1988 | Shizuya et al. | 416/97 R |

FOREIGN PATENT DOCUMENTS

| | | | |
|---|---|---|---|
| 2189553 | 10/1987 . | | |
| 1113865 | 12/1981 | Canada | 416/97 R |
| 0091799 | 10/1983 | European Pat. Off. | 416/97 R |
| 1115948 | 6/1968 | United Kingdom . | |
| 1508571 | 4/1978 | United Kingdom . | |
| 2112467 | 7/1983 | United Kingdom . | |
| 2112468 | 7/1983 | United Kingdom . | |
| 2165315 | 4/1986 | United Kingdom . | |

*Primary Examiner*—Edward K. Look
*Assistant Examiner*—Mark Sgantzos
*Attorney, Agent, or Firm*—Cushman Darby & Cushman

[57] ABSTRACT

A gas turbine engine is provided with turbine stators which have hollow aerofoils. The aerofoils are internally cooled by a flow of air the path of which is defined by walls. The wall has a curved deflector at its outer end which causes air to flow over the wall end and down the other side of the wall. An extension member ensures that the air does not break away from the surface of the wall and is preferably made from sheet metal so as to provide a light, easily made structure.

11 Claims, 2 Drawing Sheets

COOLING AIR COOLED GAS TURBINE AEROFOIL

FIELD OF THE INVENTION

The present invention relates to aerofoils of the kind utilized on the turbine section of a gas turbine engine.

BACKGROUND OF THE INVENTION

The invention is directed primarily at those aerofoils which form part of non-rotating stators, but by suitable adaptation may be utilised in the rotary aerofoils of turbine blades.

It is known to cool turbine stators by forming them from hollow structures and passing pressurised air through them. In order to ensure maximum cooling of the inner surface of the aerofoils of the stators, passageways are formed by joining opposing surfaces with walls which lie along the length of the aerofoil interior, and the cooling air caused to flow along those passageways.

The elongate walls act as fins which extract heat from the aerofoil by conduction and pass it to the air which flows in contact therewith. Clearly, in order that the air may extract the heat efficiently, it must flow in contact with the walls. Further, the air pressure must also be maintained as high as possible, despite the normally tortuous path it is constrained to follow through the aerofoil.

Whilst the air is confined by the walls, both criteria are met, however, when the air again reverses its direction of flow over an end of the last wall in cooling air flow series, it tends to break away from the downstream surface of that wall, thus reducing its ability to remove heat from the downstream side of the last wall.

British patent GB2165315B achieves delaying of breakaway by providing a combined deflector/entrainer in the form of a curved member, aided by an aerodynamically shaped wall end. The constraining effect of the member and the shape of the wall end ensures that air passing therebetween does so such that on leaving that area, it tends to stay attached to the downstream surface of the wall. Further, the outer surface of the curved member is so shaped as to provide a Coanda effect on the air flowing thereover and that airflow consequently leaves the member in a direction parallel with the ejected airflow, rather than meeting it in a manner which would cause turbulence and breakaway.

The benefit, though real relative to art prior to GB2165315B, is short lived, because breakaway does occur further along the length of the downstream side of the wall, with consequent loss of cooling efficiency.

SUMMARY OF THE INVENTION

The present invention seeks to provide an improved air cooled turbine aerofoil.

According to the present invention an air cooled turbine aerofoil comprises a hollow structure having cooling air passageways defined by the aerofoil and one or more walls which span the structure interior and extend lengthwise thereof, the wall or last wall in cooling airflow series having an end surrounded in spaced relationship by a curved cooling air deflector, and a downstream surface with respect to the effective direction of flow of cooling air through the aerofoil which, with features on the aerofoil interior, removably support a plate in spaced relationship with the interior sides of the aerofoil, the plate in turn supporting an extension member to the curved deflector which lies parallel to and in spaced relationship with said downstream surface of said last wall.

BRIEF DESCRIPTION OF THE DRAWINGS

The invention will now be described, by way of example and with reference to the accompanying drawings in which.

DETAILED DESCRIPTION OF THE INVENTION

Figure 1:
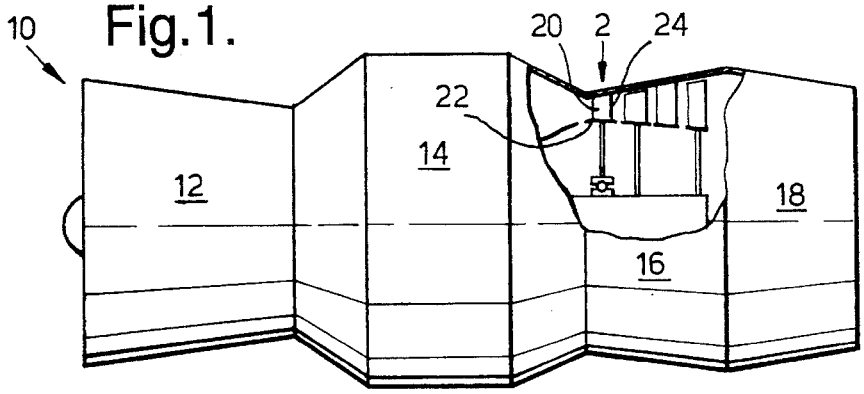
FIG. 1 is a diagrammatic view of a gas turbine engine incorporating air cooled aerofoils in accordance with the present invention.

Referring to FIG. 1, a gas turbine engine 10 has a compressor 12, combustion equipment 14, a turbine section 16 and a jet pipe 18.

In operation, the products of combustion flow onto the aerofoils of a stage of high pressure guide vanes 20, otherwise known as stator vanes. The temperature of the 0 combustion gases is extremely high and it is common practice to provide a flow of cooling air through the interior of the vanes 20. The air is injected in known manner at positions in the roots 22 of the vanes, at or near its upstream end and the majority of the cooling air flow, having passed along serpentine or tortuous paths, exits at or near the trailing edge 24 of the aerofoil. The effective direction of flow of the cooling air is thus downstream relative to the direction of flow of gases through the engine 10.

Figure 2:
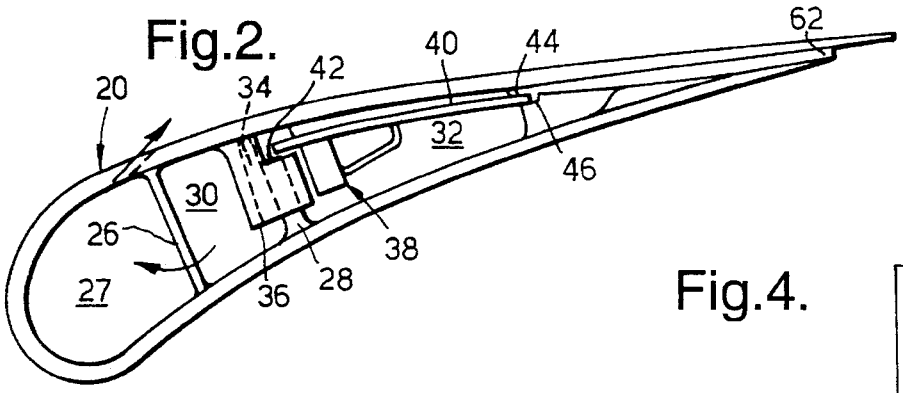
FIG. 2 is a view in the direction of arrow 2 into the interior of the air cooled aerofoil of FIG. 1.

Referring now to FIG. 2 in which the aerofoil profile of one vane 20 is clearly seen, this being representative of all the vanes 20 in the stage of vanes.

A pair of walls 26, 28 span the hollow interior of the vane 20. In the particular example, each wall has an outer end with respect to the engine axis, which is spaced from the outer, sealed end of the vane 20. Each wall extends lengthwise of the aerofoil as is best seen with respect to wall 28, in FIG. 3. In operation pressurised air enters a passageway 30 defined by walls 26, 28 via the root of the vane 20. The air flows outwardly of the engine axis and on reaching the end. extremities of the walls 26, 28, branches into passage 27 and a space 32. Passages 27 and 30 could be entirely separate, each receiving its own airflow.

The air which flows into passageway 27 exits therefrom via angled holes in the suction wall of the aerofoil in known manner. Some of the air which flows into space 32 does so via a passageway 34 defined by the end of wall 28 and a curved deflector member 36, and a deflector extension member 38 which lies substantially parallel with a lengthwise portion of the downstream surface of the wall 28. The curved deflector member 36 and the extension member 38 are so shaped and aligned, with the extension member slightly spaced from the deflector member, so that their respective outer surfaces combine and cause air flowing outside the passageway 34 to effectively adhere to the outer, convex surface of the deflector member 36 and to continue along the outer surface of the extension member 38 so as to join the flow from within the passage defined by the extension member 38, generating little, if any, turbulence and thus avoiding breakaway from the downstream surface of wall 28. Contact between the cooling air and wall 28 is thus maintained over a greater distance at this part of the cooling process than in any prior art arrangements, and therefore, heat removal efficiency is improved.

The extension member 38 is formed from sheet metal and is supported on a sheet metal plate 40, which itself is supported chordally of the aerofoil by and between a groove 42 in the downstream face of wall 28, and rows of local protuberances 44 and 46 on respective inner surfaces of the aerofoil.

Figure 3:
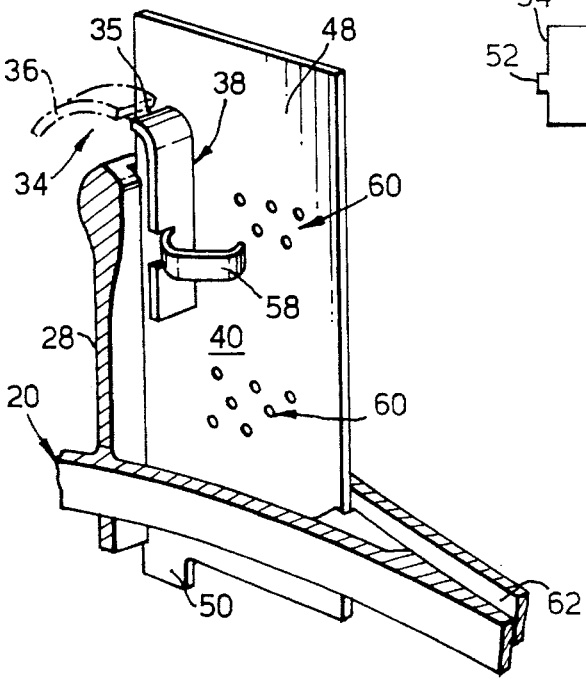
FIG. 3 is a pictorial part view of the aerofoil of FIGS. 1 and 2.

Referring to FIG. 3. The respective shapes and positions of the wall 28, the deflector member 36, the extension member 38 and the plate 40 are more clearly seen. The plate 40 has tabs 48, 50 which in situ fit into slots (not shown) in the shroud and platform (not shown) of the guide vane 20. When fitted thus, the tabs 48, 50 are bent so as to retain the plate 40 against movement radially of the engine 10. Alternatively, the plate 40 could be pinned in position via the tabs 48, 50, though this feature is not shown.

Figure 4:
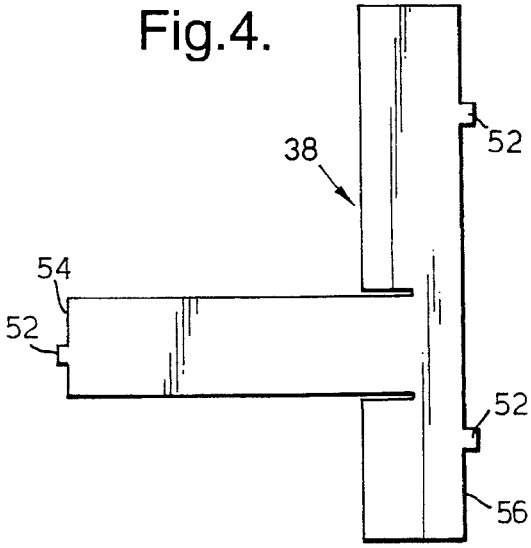
FIG. 4 is an enlarged developed view of a feature of FIG. 3.

Fixing of the plate 40 as described hereinbefore enables fixing of the extension member 38 to the plate 40 before the plate 40 is positioned within the aerofoil. Moreover, the plate is easily removable by straightening the tabs or pulling the pins (not shown). As is seen in FIG. 4, prior to shaping, the developed form of the extension is stamped out or otherwise produced, and includes small location tabs 52 which on assembly, after shaping, will fit into pre-formed slots (not shown) in the plate 40, to hold the extension member in position, at which point it will be brazed to the plate 40.

Shaping of the developed form of the extension member 38 will be effected so as to ensure that the edges 54, 56 will lie in a plane common with the plane of that surface of the plate 40 which those edges will abut when fitted. The shape achieved will also provide a short tube 58 which will act as a deterrent against airflow prematurely breaking away from the outer surface of the extension member during operation, and if appropriately profiled, would again reduce pressure loss.

In the present example, the deflector member 36 and extension member 38 are shown as respective cast and sheet metal pieces. However they could be integral, ie formed from one piece of sheet metal. Where an integral structure is used, leakage air holes (not shown) would take the place of the slot 35.

In FIG. 3 small holes 60 are provided in the plate 40. These holes represent impingement cooling holes and if provided they will enable impingement cooling of the inner surface of the suction wall of the aerofoil.

All of the air which passes into space 32 in the aerofoil 20 flows therefrom to the turbine gas annulus via a slot or slots 62, so as to provide film cooling to the aerofoil exterior.

Figure 5:
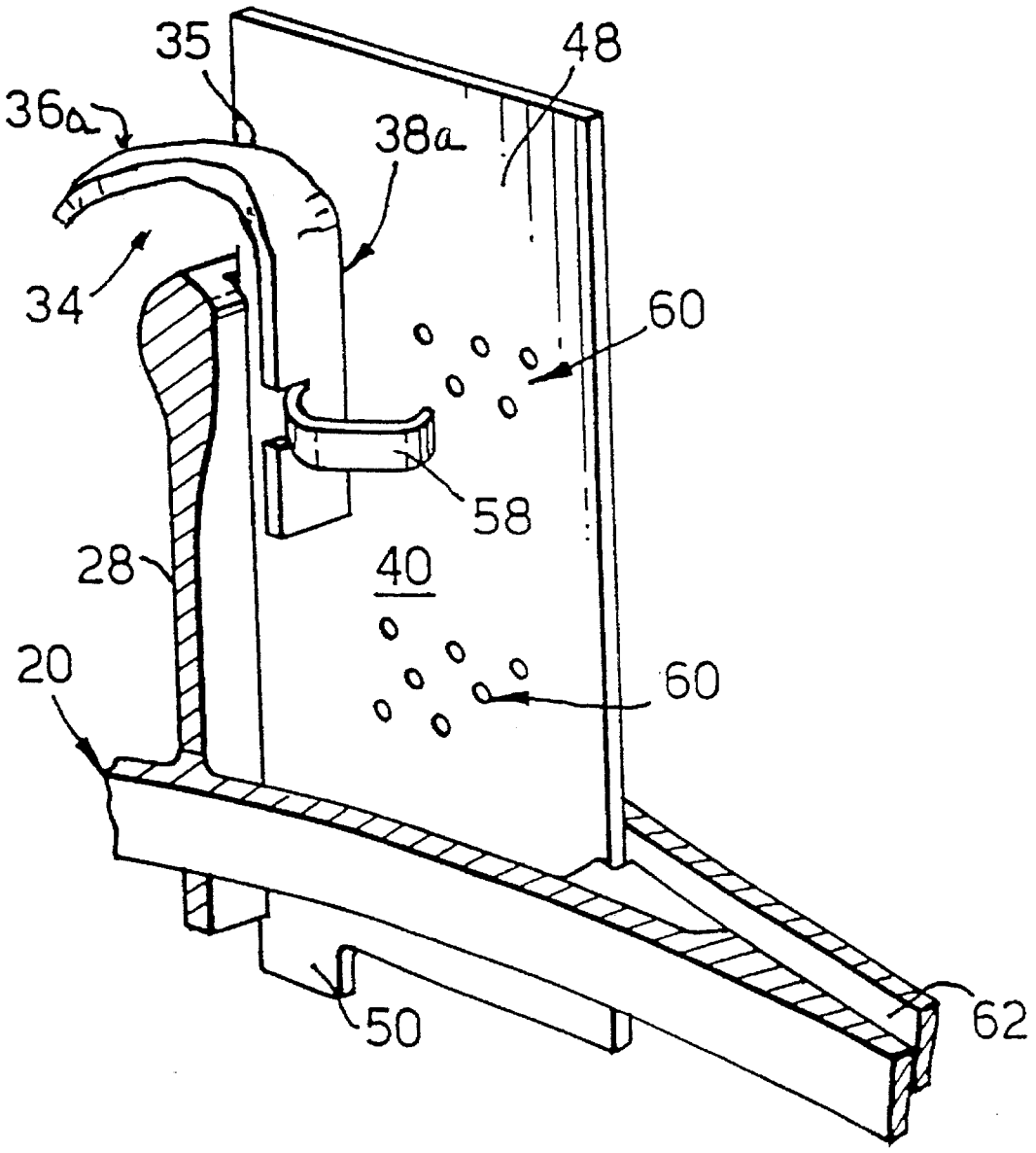
FIG. 5 is a view similar to FIG. 3, but showing the integral form of the deflector and deflector extension member.

FIG. 5 is a view showing the integral formation of the deflector 36*a* and deflector extension 38*a*.

The present invention achieves the following advantages over known prior art.

(a) Prolonged contact between cooling air and wall surface, thus providing more efficient cooling from a given airflow.

(b) Simplicity of manufacture resulting in cost reductions.

(c) Lightweight, thin construction, thus avoiding flow blockage and avoiding paying unacceptable weight penalties in exchange for improved cooling efficiency.

If the present invention is applied to rotary turbine aerofoils, the manner of fixing the plate 40 may have to be made more robust, to counter the considerable centrifugal forces which are generated during operation of an associated engine.

Whilst the preferred embodiment of the present invention as described herein is manufactured from sheet metal, suitable ceramics may be utilised for either part, bearing in mind that the simplicity of manufacture and assembly would not be lost. Further, either or both the parts may be cast from a suitable metal, which would be lighter than the metal from which the aerofoil is cast, there being no requirement for metallurgical compatibility since no fixing of one to the other by welding or the like is called for.

I claim:

1. An air cooled gas turbine aerofoil comprising a hollow aerofoil structure which includes a wall spanning the interior thereof with said interior including interior sides and support portions, said wall extending lengthwise of said aerofoil so that said aerofoil and said wall define cooling air passageways internally of said aerofoil, said wall having one end and a curved cooling air deflector which surrounds said one end of the said wall, said wall having a downstream surface with respect to the effective direction of flow of cooling air through said aerofoil, a plate of heat resistant material removably supported by said wall and said support portions on the aerofoil interior in spaced apart relationship with the interior sides of said aerofoil, and an extension member supported by said plate which is an extension of said curved deflector and which lies parallel to and in spaced relationship with said downstream surface of said wall.

2. An air cooled gas turbine aerofoil as claimed in claim 1 wherein the curved deflector member and the extension member are integral in form.

3. An air cooled gas turbine aerofoil as claimed in claim 1 wherein the curved deflector member is an integrally cast feature of the aerofoil.

4. An air cooled gas turbine aerofoil as claimed in claim 1 wherein the plate is an impingement plate.

5. An air cooled gas turbine aerofoil as claimed in claim 1 wherein the extension member includes a tubular portion on the side thereof remote from said downstream surface on said wall.

6. An air cooled gas turbine aerofoil as claimed in claim 5 wherein one side of the tubular portion is defined by the plate.

7. An air cooled turbine aerofoil as claimed in claim 2 wherein the plate and extension member are formed from sheet metal.

8. An air cooled gas turbine aerofoil as claimed in claim 2 wherein of the plate and extension member, at least the extension member is formed from a ceramic.

9. An air cooled gas turbine aerofoil as claimed in claim 2 wherein of the plate and extension member, at least the extension member is a cast metal structure.

10. An air cooled gas turbine aerofoil as claimed in claim 1 wherein the aerofoil comprises a stator aerofoil.

11. An air cooled gas turbine aerofoil as claimed in claim 1 wherein the aerofoil comprises a rotor aerofoil.

* * * * *